US005809817A

United States Patent [19]

Ginzburg

[11] Patent Number: 5,809,817

[45] Date of Patent: Sep. 22, 1998

[54] OPTIMUM STRIP TENSION CONTROL SYSTEM FOR ROLLING MILLS

[75] Inventor: Vladimir B. Ginzburg, Pittsburgh, Pa.

[73] Assignees: Danieli United, A Division of Danieli Corporation Corporation; International Rolling Mill Consultants, Inc., both of Pittsburgh, Pa.

[21] Appl. No.: 814,328

[22] Filed: Mar. 11, 1997

[51] Int. Cl.[6] ..... B21B 37/48

[52] U.S. Cl. ..... 72/8.6; 72/11.4; 72/10.3; 72/12.3; 72/205; 72/365.2

[58] Field of Search ..... 72/7.4, 8.3, 8.6, 72/10.3, 11.1, 11.4, 12.3, 205, 10.1, 10.4, 365.2

[56] References Cited

U.S. PATENT DOCUMENTS

| | | | |
|---|---|---|---|
| 3,961,510 | 6/1976 | Kovacs . | |
| 3,996,776 | 12/1976 | Bryant et al. | 72/9.4 |
| 4,513,594 | 4/1985 | Ginzburg et al. . | |
| 4,548,063 | 10/1985 | Cox . | |
| 4,674,310 | 6/1987 | Ginzburg . | |
| 4,706,479 | 11/1987 | Tominaga . | |
| 5,012,660 | 5/1991 | Peterson et al. | 72/205 |
| 5,103,662 | 4/1992 | Fapiano | 72/205 |
| 5,241,847 | 9/1993 | Tsugeno et al. | 72/7.4 |
| 5,479,803 | 1/1996 | Imanari . | |
| 5,546,779 | 8/1996 | Ginzburg | 72/11.4 |

FOREIGN PATENT DOCUMENTS

| | | | |
|---|---|---|---|
| 59-159209 | 9/1984 | Japan | 72/9.5 |
| 62-187513 | 8/1987 | Japan | 72/8.6 |
| 5-15918 | 1/1993 | Japan | 72/12.4 |
| 5-57318 | 3/1993 | Japan | 72/10.1 |
| 5-96316 | 4/1993 | Japan | 72/8.3 |
| 6-142735 | 5/1994 | Japan | 72/8.6 |

*Primary Examiner*—Joseph J. Hail, III
*Assistant Examiner*—Ed Tolan
*Attorney, Agent, or Firm*—Armstrong, Westerman, Hattori, McLeland & Naughton

[57] ABSTRACT

A system and method for achieving an optimum interstand strip tension providing substantially equal loading of adjacent stands of a tandem rolling mill where such optimum tension is determined by the expression $$S1_{(opt)} = \frac{A2 - A1}{B1 - B2}$$

where A1 and B1 are, respectively, the load ratio intercept and the slope of the load ratio versus interstand tension function for a first mill rolling stand, and A2 and B2 are, respectively, the load ratio intercept and the slope of the load ratio versus interstand tension function for an adjacent second mill rolling stand, and whereby the rolling capacity of the mill is substantially fully utilized.

13 Claims, 6 Drawing Sheets

OPTIMUM STRIP TENSION CONTROL SYSTEM FOR ROLLING MILLS

BACKGROUND

1. Field of the Invention

This invention relates to a system for controlling interstand strip tension in a tandem rolling mill, particularly a cold rolling mill, and wherein interstand strip tension is measured and compared to a calculated reference strip tension and the latter is used to determine a reference downstream mill stand motor speed which is compared to a measured downstream mill stand motor speed and used to control the speed of the downstream mill stand to produce an interstand strip tension providing loading of adjacent mill stands as close as possible to each other.

2. Description of Prior Art

During rolling of metal strip in a rolling mill, strip tension is provided to achieve: 1) improved steering of the strip through the mill; 2) improvement of strip flatness, and 3) reduction of roll separating force.

Strip tension usually is achieved by regulating one of the following rolling parameters: 1) torque provided by the pay-off reel, tension reels or bridle or looper rolls; 2) the speed of one of two adjacent tandem mill stands, or 3) the roll gap of one of two adjacent tandem mill stands.

Examples of such prior art include: U.S. Pat. Nos. 3,961,510 and 5,479,803 in which a looper is used to impose constant tension on a strip; U.S. Pat. No. 4,513,594 in which interstand tension is controlled either by speed control of the first stand and/or by gap control of a downstream stand, or by a tension control looper; U.S. Pat. No. 4,548,063 which discloses a method and device for controlling tension in the strip on the entry side of work rolls by controlling the torque of the pay-off reel drive motor; U.S. Pat. No. 4,674,310 which shows controlling strip tension by contact rolls mounted on a pivoted arm and contacting the strip with variable force; and U.S. Pat. No. 4,706,479 in which interstand strip tension is controlled in accordance with the speed of the roll stand drive motor.

Strip specific tension commonly is selected as a function of the strip thickness; a typical relationship is shown in FIG. 1. The principle deficiency of this simplified method of selecting strip tension is that it generally produces uneven loading of the mill stands and, as a result, the mill rolling capability is underutilized.

SUMMARY OF THE INVENTION

The present optimum strip tension control system takes into consideration that the distribution of the mill load between two adjacent mill stands is affected greatly by the interstand strip tension. Therefore this system is designed to maintain the interstand tension at the magnitude that provides loading of both adjacent mill stands as close as possible equal to each other. To accomplish this a computerized strip flatness model was developed and into which data on the following parameters are input:

$h_0$=stand 1 entry strip thickness;

$h_2$=stand 2 exit strip thickness;

W=strip width;

H=strip material hardness characteristics;

G=mill structural data (mill stand dimensions determining mill stiffness);

$V_2$=stand 2 motor speed;

$S_0$=entry strip tension of stand 1;

$S_1$=interstand strip tension between stands 1 and 2;

$S_2$=exit strip tension of stand 2, and

C=available strip crown control range (e.g. in microns or microinches).

Based on the above data, the strip flatness model calculates the exit strip thickness, $h_1$, at stand 1 and the roll separating force $P_1$ for stand 1 and the roll separating force $P_2$ for stand 2. These latter three parameters, along with available power of the main drive of stand 1, $N_1$, and the available power of the main drive of stand 2, $N_2$, are used as input data for a computerized mill power model which calculates the load ratio LR1 of stand 1 and the load ratio LR2 of stand 2. LR1 and LR2 then are used as input data to a computerized strip tension model to adjust strip tension so that the load ratios LR1 and LR2 are as close as possible to each other. This is accomplished by iterative calculation, after which the last calculated interstand strip tension $S_1$ becomes an interstand strip tension reference signal $S_{1r}$. The signal $S_{1r}$ then is input into a strip tension regulator where it is compared with an actual interstand strip tension signal $S_{1a}$. Based on the difference between $S_{1r}$ and $S_{1a}$, the strip tension regulator generates a speed reference $V_{2r}$ for a main drive speed regulator where signal $V_{2r}$ is compared with an actual main drive speed signal $V_{2a}$ and the speed of mill stand 2 is adjusted until the desired interstand tension is achieved.

DESCRIPTION OF PREFERRED EMBODIMENTS

FIGS. 2–5 show the relationship between main mill drive load ratio of a 68 inch 2-stand tandem cold rolling mill and interstand strip tension for varying degrees of thickness reduction of a strip of AISI SAE 1008 steel having a width of 43 inches, an entry thickness of 0.12 inch and an exit thickness of 0.055 inch and wherein the stand 1 strip entry tension is 1.3 ksi and the strip exit tension of that stand is 15.0 ksi. As will be seen from those Figs., the interstand strip tension at which both rolling mill stands are equally loaded increases as the reduction by the first mill stand increases. Therefore a principal priority of the present invention is to maintain the interstand tension at a value which provides loading of both mill stands as close as possible to each other. In the examples illustrated by FIGS. 2–5, both the entry strip tension of stand 1 and the exit strip tension of stand 2 are maintained constant.

Figure 6:
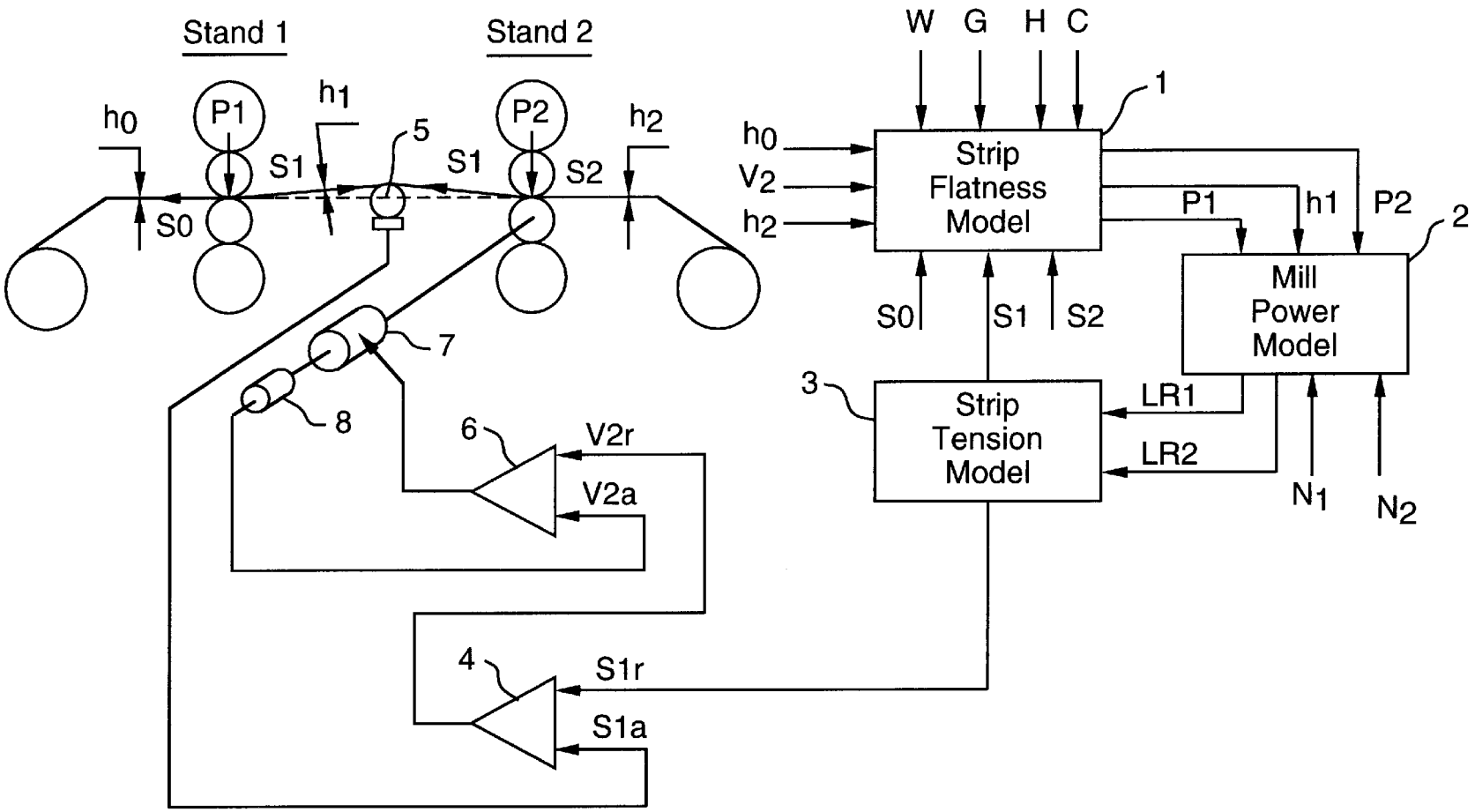
FIG. 6 is a block diagram of the present invention as applied to a two stand tandem cold rolling mill.

FIG. 6 is a block diagram of the optimum strip tension control system of the invention. In this Fig. the numeral 1 denotes the strip flatness model into which is fed data representing $h_0$, the stand 1 entry strip thickness; $h_2$, the stand 2 exit strip thickness; $V_2$, the stand 2 strip velocity or main drive motor speed; W, the strip width; G, the mill stiffness factor; H, the strip hardness; C, the available strip crown control range; $S_0$, the entry strip tension of stand 1; $S_1$, the interstand strip tension between stands 1 and 2, and $S_2$, the exit strip tension of stand 2. Based on these data, the strip flatness model 1 then calculates $h_1$, the thickness of strip exiting stand 1, roll separating forces $P_1$ for stand 1 and $P_2$ the roll separating force for stand 2.

These latter calculated data, $h_1$, $P_1$ and $P_2$, along with $N_1$ and $N_2$, the available power of the main drives of stands 1 and 2 respectively, then are input into the mill power model denoted by the numeral 2. The mill power model 2 then calculates the load ratios LR1 and LR2 of stand 1 and 2 respectively. Load ratio is the ratio of actual power to nominal power, where nominal power is the power at which the mill can be loaded and operated continuously without overheating. These latter parameters then are input into the strip tension model denoted by the numeral 3 and are used by that model to adjust, by iterative calculation, the interstand strip tension $S_1$ so that the load ratios LR1 and LR2 are as close as possible to each other. The last calculated interstand strip tension $S_1$ becomes the interstand strip tension reference signal $S_{1r}$ which is input, along with an actual interstand strip tension signal $S_{1a}$ generated by a tensiometer 5 installed between stands 1 and 2, into the strip tension regulator 4. In the latter regulator, $S_{1r}$ is compared with $S_{1a}$ and, based on the difference between $S_{1r}$ and $S_{1a}$, the strip tension regulator 4 generates a speed reference signal $V_{2r}$ for a main drive speed regulator 6 of stand 2. In regulator 6, $V_{2r}$ is compared with the actual speed signal $V_{2a}$ of a stand 2 main drive motor 7, as determined by tachometer 8, and the speed of the mill stand 2 is adjusted until the desired interstand tension is achieved to provide equal loading of the two mill stands. Such adjustment is achieved by inputting an appropriate signal from the speed regulator 6 to stand 2 main drive motor 7, as shown in FIG. 6.

Figure 1:
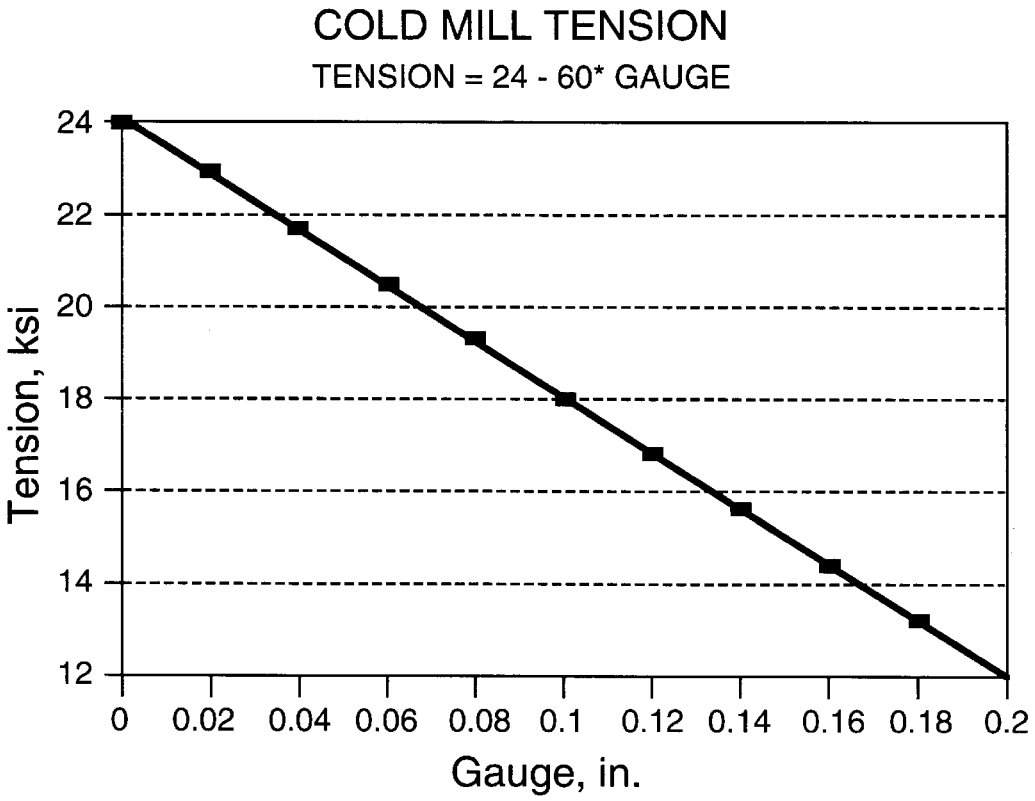
FIG. 1 Prior Art
FIG. 1 is a graph relating strip tension and strip thickness.
Figure 2:
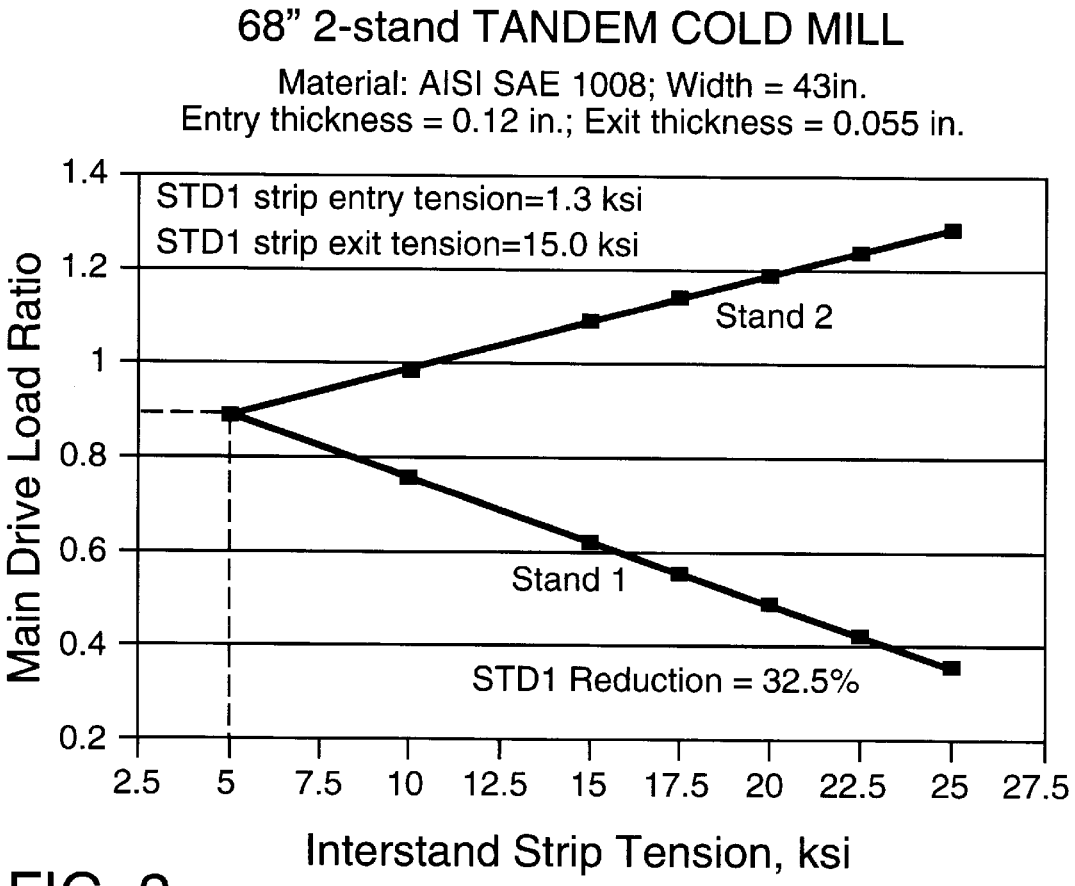
FIGS. 2–5 are graphs relating load ratio and interstand strip tension for stand 1 strip thickness reductions of, respectively, 32.5%, 35%, 37.5% and 40%.
Figure 3:
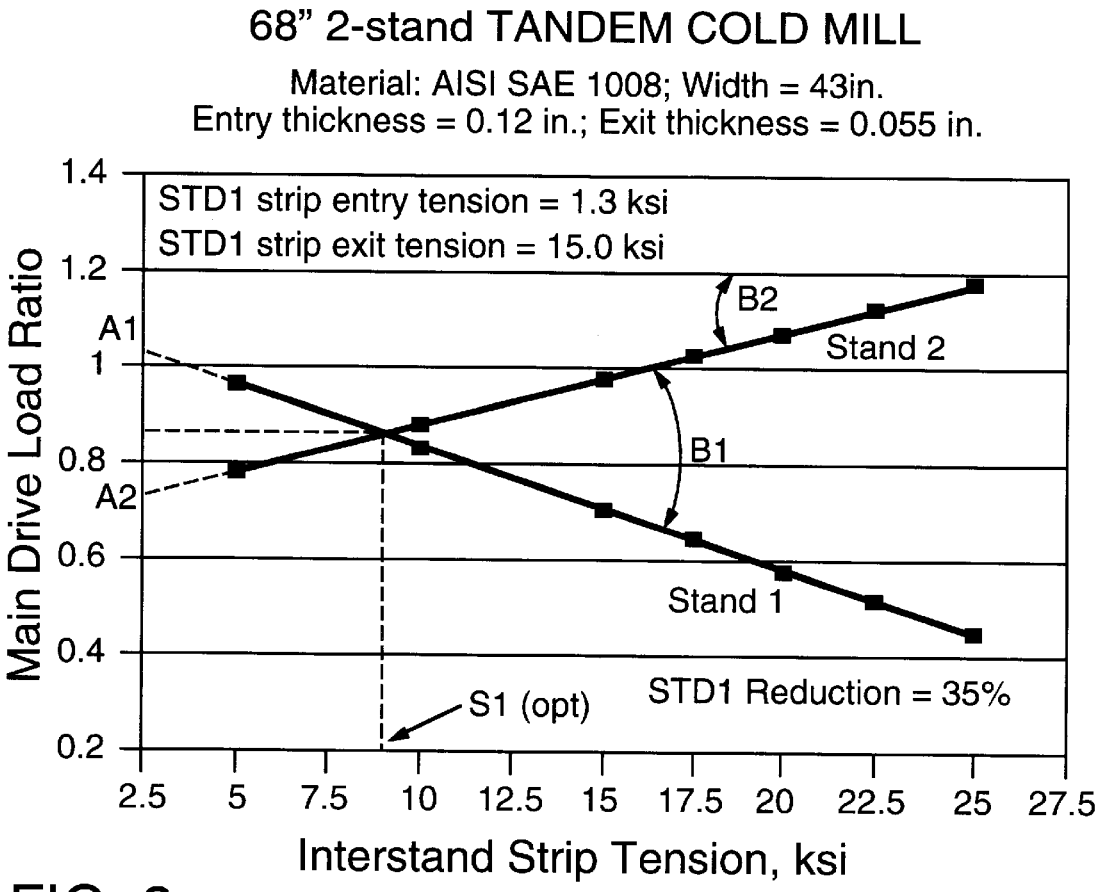
Figure 4:
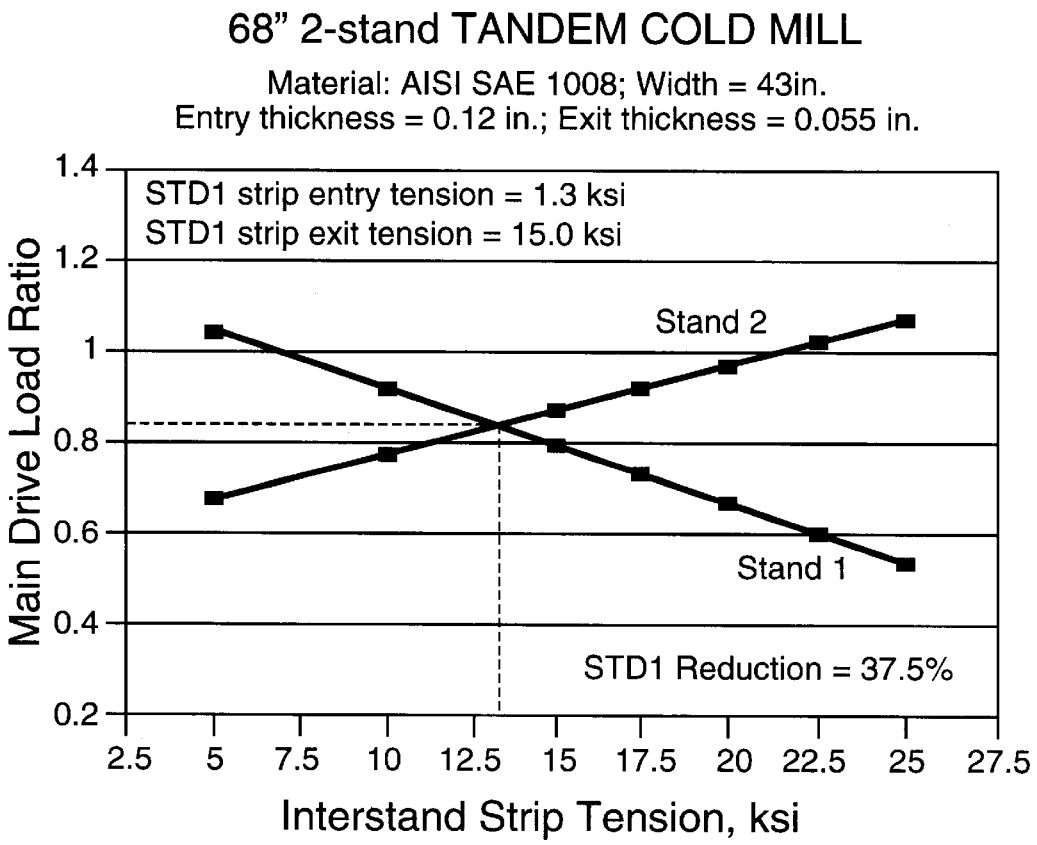
Figure 5:
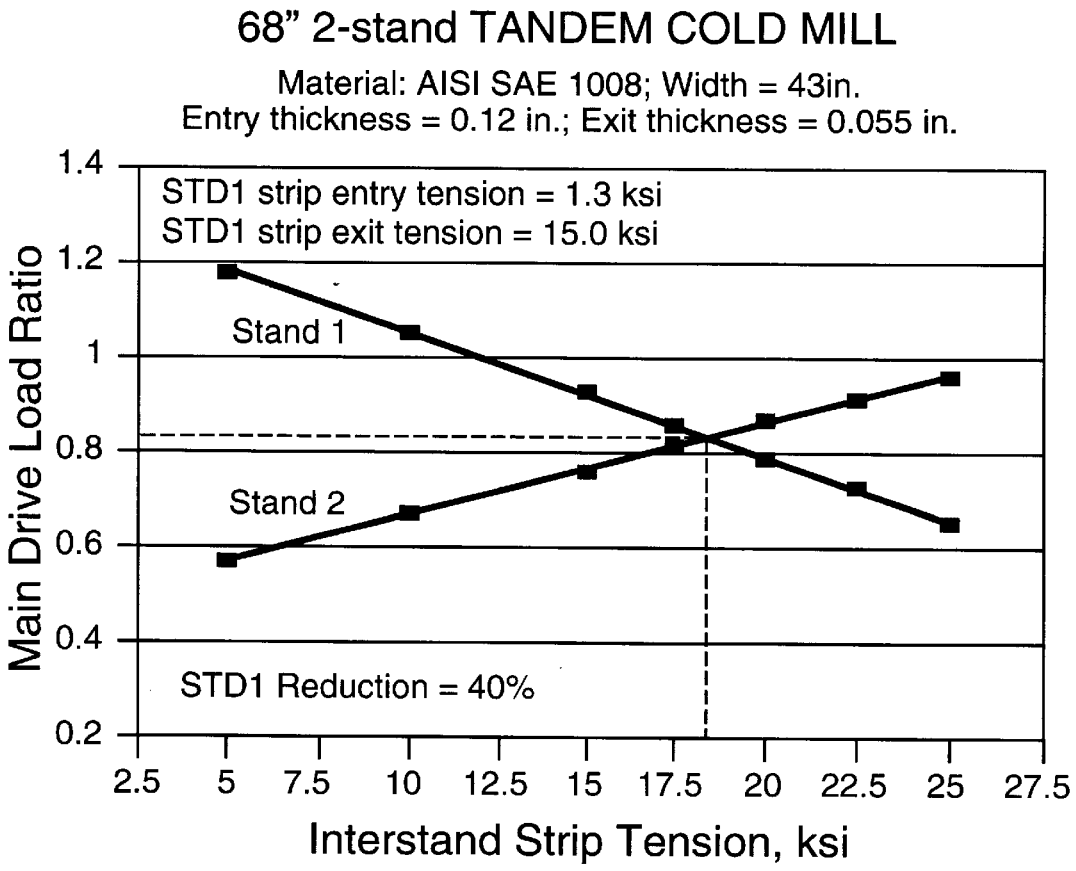

Referring again to FIGS. 2–5, it is seen that, in each case, the drawing comprises, for each percent reduction in the first stand, a pair of graphs each having a slope representing the load ratio versus interstrip tension function for each of stands 1 and 2. In each drawing, the graphs intersect each other and thereby define an optimum interstand strip tension $S1_{(opt)}$ on the horizontal coordinate (abscissa) as shown, for example, in FIG. 3. As also shown in FIG. 3, the load ratio intercept of the graph for stand 1, i.e. the point on the vertical coordinate (ordinate) where the stand 1 graph, extrapolated to intercept the ordinate at zero tension, is denoted as "A1" and the point of the abscissa where the stand 2 graph, also extrapolated to intercept the abscissa at zero tension, is denoted as "A2". The same is true for FIGS. 2, 4 and 5, and each case assumes that the abscissa of the drawing starts at zero value of the interstand strip tension factor. The respective slopes for the stand 1 and stand 2 graphs are denoted as "B1" and "B2" as also shown in FIG. 3 and as also would be true for FIGS. 2, 4 and 5. The load ratios of stands 1 and 2 may be expressed by the following equations as a function of the interstand tension S1:

$$LR1=A1=(B1)\times(S1) \quad \text{Equation (1)}$$

$$LR2=A2=(B2)\times(S1) \quad \text{Equation (2)}$$

where

A1 and B1 are, respectively, the load ratio ordinate intercept and the slope of the load ratio versus tension function for stand 1, as above described;

A2 and B2 are, respectively, the load ratio ordinate intercept and the slope of the load ratio versus tension function for stand 2, as above described, and S1 is the interstand strip tension.

For achieving optimum mill loading, i.e. as nearly as possible to equal loading of the two mill stands, it is necessary to maintain the following condition:

$$LR1=LR2 \quad \text{Equation (3)}$$

From equations (1)–(3), the following expression is obtained for such optimum interstand tension, $S1_{(opt)}$:

$$S1_{(opt)}=\frac{A2-A1}{B1-B2}$$

What is claimed is:

1. An optimum strip tension control system for a tandem rolling mill having at least a first upstream driven rolling stand and at least a second downstream driven rolling stand defining an interstand distance between adjacent stands and adapted to contain an interstand section of metal strip being rolled, said system comprising means to calculate load ratios of adjacent mill stands as a function of (a) strip exit thickness at the first stand, (b) roll separating forces for the first and second stands, and (c) available power of first and second stand drives, and means utilizing said calculated load ratios to adjust interstand strip tension to a value at which the load ratios of adjacent mill stands are substantially equal, thereby providing substantially full utilization of the mill rolling capability.

2. A rolling mill control system for providing substantially full utilization of mill rolling capability, said mill having at least a first driven upstream rolling stand and at least a second driven downstream rolling stand and adapted to contain an interstand section of metal strip being rolled, said system comprising a computer strip flatness model to calculate exit thickness of the strip at a first, upstream stand and roll separating forces for adjacent upstream and downstream mill stands, a computer mill power model to receive data output from the strip flatness model along with available power of adjacent upstream and downstream stands and to calculate load ratios of each such stand, a computer strip tension model to receive data output from the mill power model and to calculate an interstand strip tension reference signal, means to sense actual interstand strip tension and to generate an actual interstand strip tension signal, means to sense actual mill stand drive speed and to generate an actual drive speed signal, means to compare the tension reference signal with the actual strip tension signal and to generate a drive speed reference signal and to compare it with the actual drive speed signal, and means responsive to the compared speed signals to adjust speed of a downstream mill stand drive to provide an interstand strip tension value at which adjacent mill stands are substantially equally loaded.

3. An optimum strip tension control system for a tandem rolling mill having at least a first upstream rolling stand and at least a second downstream rolling stand defining an interstand distance between adjacent stands and adapted to contain an interstand section of metal strip being rolled, said system comprising means for achieving an optimum interstand strip tension providing substantially equal loading of adjacent mill stands and thereby substantially full utilization of the mill rolling capability, and wherein the optimum interstand strip tension is defined by the expression:

$$S1_{(opt)}=\frac{A2-A1}{B1-B2}$$

where A1 and B1 are, respectively, the load ratio intercept and the slope of the load ratio versus interstand tension function for a first mill rolling stand, and A2 and B2 are, respectively, the load ratio intercept and the slope of the load ratio versus interstand tension function for an adjacent second mill rolling stand.

4. A control system according to claim 3 comprising means to calculate the load ratios of the first and second stands, means to calculate an interstand strip tension reference signal and to compare said reference signal to an actual interstand strip tension signal and to generate a second stand main drive motor speed reference signal, and means to receive the second stand main drive motor speed reference signal and to compare it to an actual second stand main drive motor speed signal and, responsive thereto, to regulate the speed of the second stand main drive motor in a manner to achieve said optimum interstand strip tension.

5. An optimum strip tension control system for a tandem rolling mill having at least a first upstream rolling stand and at least a second downstream rolling stand defining an interstand distance between adjacent stands and adapted to contain an interstand section of metal strip being rolled, said system comprising a second stand speed adjuster adapted to receive a second stand main drive motor speed reference signal dependent upon the difference in an interstand strip tension reference signal and an actual interstand strip tension signal, to compare said second stand main drive motor speed reference signal and an actual second stand main drive motor speed signal, to generate an adjusting second stand main drive motor speed signal, and, in accordance with said adjustive speed signal, to regulate the speed of the second stand main drive motor to achieve a desired optimum interstand strip tension providing substantially equal loading of adjacent mill stands and thereby substantially full utilization of mill rolling capability.

6. A strip tension control system providing substantially constant loading and substantially full utilization of the rolling capacity of the stands of a tandem rolling mill having at least a first upstream rolling stand and at least a second downstream rolling stand defining an interstand distance between adjacent stands and adapted to contain an interstand section of metal strip being rolled, said system comprising:

a) means to determine the speed of the main drive motor of the second stand and interstand strip tension, b) first computer means, with input of data from means a) and, with input of further data defining the first stand entry strip thickness, the desired second stand exit strip thickness, strip width, mill stiffness characteristic, strip hardness, entry strip tension of the first stand, exit strip tension of the second stand and interstand strip tension, to calculate the roll separating forces of the first and second stands and the exit strip thickness of the first stand;

c) second computer means using the calculated data from the first computer means and data representing available power of main drives of the first and second stands to calculate the load ratios of the first and second stands;

d) third computer means using the calculated data of the second computer means to calculate interstand strip tension for input into the first computer means, and an interstand strip tension reference signal;

e) means, using the interstand strip tension reference signal from the third computer means and an actual interstand strip tension signal, to generate a second stand main drive motor speed reference signal, and f) means, using the second stand main drive motor speed reference signal and an actual second stand main drive motor speed signal to regulate the speed of the second stand main drive motor to achieve an interstand strip tension which provides substantially equal loading of the first and second stands and substantially full utilization of the mill rolling capability.

7. A method according to claim 6, comprising determining the optimum interstand strip tension by the expression:

$$S1_{(opt)} = \frac{A2 - A1}{B1 - B2}$$

where A1 and B1 are, respectively, the load ratio intercept and the slope of the load ratio versus interstand tension function for a first mill rolling stand, and A2 and B2 are, respectively, the load ratio intercept and the slope of the load ratio versus interstand tension function for an adjacent second mill rolling stand.

8. An optimum strip tension control system for a tandem rolling mill having at least a first upstream rolling stand and at least a second downstream rolling stand defining an interstand distance between adjacent stands and adapted to contain an interstand section of metal strip being rolled, said system comprising:

a) a computerized strip flatness model adapted to receive, as input data, first stand strip entry thickness, second stand strip exit thickness, second stand main drive motor speed, strip width, mill stiffness characteristic, strip hardness, available strip crown control range, entry strip tension of the first stand, exit strip tension of the second stand, and the interstand strip tension between the first and second stands, and to generate signals representing roll separating forces for the first and second stands, and the strip exit thickness of the first stand;

b) a computerized mill power model adapted to receive, as input data from the strip flatness model, the roll separating forces for the first and second stands and the strip exit thickness of the first stand, along with the available power of the main drives of the first and the second stands, and to generate signal representing the load ratios of the first and second stands;

c) a computerized strip tension model adapted to receive, as input data from the mill power model, the load ratios of the first and second stands, and to generate an interstand strip tension signal as input to the strip flatness model and an interstand strip tension reference signal;

d) a tensiometer installed in the interstand distance and adapted to generate a signal representative of actual interstand strip tension;

e) a strip tension regulator adapted to receive, as input from the tensiometer the actual interstand strip tension signal and, as input from the strip tension model, the interstand strip tension reference signal, and to generate a signal representing a second stand main drive speed reference signal;

f) a tachometer for determining the speed of the second stand main drive motor and for generating a signal representative thereof;

g) a speed regulator for the main drive of the second stand adapted to receive, as input data from the strip tension regulator, the second stand main drive speed reference signal and, as input data from the tachometer, the second stand main drive motor actual speed signal, and adapted to compare said reference and actual speed signals and to generate a corrective speed signal for input to the second stand main drive motor, whereby an interstand strip tension is achieved which provides substantially equal load ratios of the first and second stands and whereby the rolling capacity of the mill is substantially fully utilized.

9. A method of controlling rolling of a tandem rolling mill having at least a first upstream rolling stand and at least a second downstream rolling stand defining an interstand distance between adjacent stands and adapted to contain an interstand section of metal strip being rolled, said method comprising adjusting the speed of a second stand main drive motor by comparing the actual speed of a second stand main drive motor with a second stand main drive motor speed reference signal which is dependent upon the difference in an interstand strip tension reference signal and an actual interstand strip tension signal, generating an adjustive second stand main drive motor speed signal, and adjusting the speed of the second stand main drive motor in accordance with said adjustive speed signal to achieve a desired optimum interstand strip tension providing substantially equal loading of adjacent mill stands and thereby substantially full utilization of mill rolling capability.

10. A method of operating a tandem rolling mill having at least one upstream rolling stand and one downstream rolling stand to achieve substantially full utilization of the rolling capability of the mill, comprising:

a) inputting, into a strip flatness computer model, data representing first stand strip entry thickness, second stand strip exit thickness, second stand main drive motor speed, strip width, mill stiffness characteristic, strip hardness, available strip crown control range, entry strip tension of the first stand, exit strip tension of the second stand, and the interstand strip tension between the first and second stands;

b) calculating, in the strip flatness model, the roll separating forces for the first and second stands and the strip exit thickness of the first stand;

c) inputting into a mill power model the calculated data from the strip flatness model together with data representing the available power of the main drives of the first and second stands, and calculating the load ratios for the first and second stands;

d) inputting the first and second stand load ratios into a strip tension model and calculating an interstand strip tension for input into the strip flatness model and an interstand strip tension reference signal;

e) generating a signal representative of actual interstand strip tension and inputting said signal, along with the interstand strip tension reference signal, into a strip tension regulator, comparing said actual and reference interstand strip tension signals, and generating a second stand main drive motor speed reference signal, and f) generating a signal representative of the actual speed of the second stand main drive motor and inputting said signal, along with the second stand main drive motor speed reference signal, into a speed regulator for the main drive of the second stand, comparing said reference and actual speed signals, generating an adjustive speed signal and inputting the adjustive speed signal to the second stand main drive motor, thereby achieving an optimum interstand strip tension which provides substantially equal load ratios of the first and second stands and substantially full utilization of the rolling capacity of the mill.

11. An optimum strip tension control system for a tandem rolling mill having at least a first upstream rolling stand and at least a second downstream rolling stand defining an interstand distance between adjacent stands and adapted to contain an interstand section of metal strip being rolled, said system comprising a second stand speed adjuster adapted to receive a second stand main drive motor speed reference signal dependent upon the difference in an interstand strip tension reference signal and an actual interstand strip tension signal, to compare said second stand main drive motor speed reference signal and an actual second stand main drive motor speed signal, and, in accordance with said adjustive speed signal, to regulate the speed of the second stand main drive motor to achieve a desired optimum interstand strip tension providing substantially equal loading of adjacent mill stands and thereby substantially full utilization of mill rolling capability, and wherein the optimum interstand strip tension is defined by the expression:

$$S1_{(opt)} = \frac{A2 - A1}{B1 - B2}$$

where A1 and B1 are, respectively, the load ratio intercept and the slope of the load ratio versus interstand tension function for a first mill rolling stand, and A2 and B2 are, respectively, the load ratio intercept and the slope of the load ratio versus interstand tension function for an adjacent second mill rolling stand.

12. A method of controlling rolling of a tandem rolling mill having at least a first upstream rolling stand and at least a second downstream rolling stand defining an interstand distance between adjacent stands and adapted to contain an interstand section of metal strip being rolled, said method comprising adjusting the speed of a second stand main drive motor by comparing the actual speed of a second stand main drive motor with a second stand main drive motor speed reference signal which is dependent upon the difference in an interstand strip tension reference signal and an actual interstand strip tension signal, generating an adjustive second stand main drive motor speed signal, and adjusting the speed of the second stand main drive motor in accordance with said adjustive speed signal to achieve a desired optimum interstand strip tension providing substantially equal loading of adjacent mill stands and thereby substantially full utilization of mill rolling capability, and wherein the optimum interstand strip tension is defined by the expression:

$$S1_{(opt)} = \frac{A2 - A1}{B1 - B2}$$

where A1 and B1 are, respectively, the load ratio intercept and the slope of the load ratio versus interstand tension function for a first mill rolling stand, and A2 and B2 are, respectively, the load ratio intercept and the slope of the load ratio versus interstand tension function for an adjacent second mill rolling stand.

13. A method of achieving substantially full utilization of the rolling capability of a tandem rolling mill having at least two rolling stands defining therebetween an interstand distance in which may be contained an interstand section of metal strip being rolled, said method comprising determining the load ratio of each of two adjacent stands, determining the difference between an actual interstand strip tension signal and an interstand strip reference signal and, based on such difference, generating a downstream stand drive speed reference signal and comparing it to an actual downstream stand drive speed signal, and adjusting the downstream stand speed to obtain an interstand strip tension value at which adjacent stands are equally loaded.

* * * * *

UNITED STATES PATENT AND TRADEMARK OFFICE

CERTIFICATE OF CORRECTION

PATENT NO. : 5,809,817

DATED : September 22, 1998

INVENTOR(S) : Vladimir B. Ginzburg

It is certified that error appears in the above-indentified patent and that said Letters Patent is hereby corrected as shown below:

On the title page, item [73],
Change the Assignees to read:

Danieli United, A Division of Danieli Corporation; International Rolling Mill Consultants, Inc., both of Pittsburgh, Pa.

In Drawing Figures 2, 3, 4 and 5:

Delete line "STD1 strip exit tension=15.0 ksi".

Signed and Sealed this

Second Day of February, 1999

*Attest:*

*Acting Commissioner of Patents and Trademarks*

*Attesting Officer*